United States Patent [19]

Okamura

[11] Patent Number: 4,796,549

[45] Date of Patent: Jan. 10, 1989

[54] INK SUPPLYING APPARATUS

[75] Inventor: Yuuichi Okamura, Tokyo, Japan

[73] Assignee: Kabushikigaisha Tokyo Kikai Seisakusho, Tokyo, Japan

[21] Appl. No.: 105,614

[22] Filed: Oct. 8, 1987

[30] Foreign Application Priority Data

Dec. 9, 1986 [JP] Japan ..... 61-292983

[51] Int. Cl.[4] ..... B41F 31/04

[52] U.S. Cl. ..... 101/350; 101/169

[58] Field of Search ..... 101/157, 169, 349, 350, 101/363, 366, 207–210

[56] References Cited

U.S. PATENT DOCUMENTS

| | | | |
|---|---|---|---|
| 2,014,303 | 9/1935 | Weiss | 101/157 |
| 2,593,344 | 4/1952 | Richardson | 101/157 |
| 2,692,554 | 10/1954 | Bamford | 101/157 |
| 2,817,293 | 12/1957 | Willard | 101/350 |
| 2,891,471 | 6/1959 | Sengewald | 101/350 |

*Primary Examiner*—J. Reed Fisher

*Attorney, Agent, or Firm*—Foley & Lardner, Schwartz, Jeffery, Schwaab, Mack, Blumenthal & Evans

[57] ABSTRACT

An ink supplying apparatus in combination with a mesh roller comprises an ink feeding means for feeding ink onto the circumferential surface of the mesh roller, a doctor blade for contacting with the circumferential surface of the mesh roller, a pivoting means for pivotally moving the doctor blade in a sector form through a pivot parallel to the mesh roller; and a shifting means for adjusting the space between the doctor blade and the mesh roller.

By operating the pivoting means and the shifting means, the contact angle of the doctor blade to the mesh roller can be freely controlled between the tangential line following to the revolving direction of the mesh roll to the tangential line in the counter direction of its revolving. Also the contact pressure can be freely controlled by these means.

1 Claim, 4 Drawing Sheets

INK SUPPLYING APPARATUS

BACKGROUND OF THE INVENTION (1) Field of the Invention

The present invention relates to an ink supplying apparatus adapted for a rotary press using different color inks having various viscosities. More particularly, the present invention relates to an ink supplying apparatus which can always supply a constant quantity of ink to the downstream roller in combination with the cells formed in a mesh roller.

(2) Description of the Prior Art

Conventionally, ink has been constantly supplied by using a mesh roller. In detail, ink is excessively applied to the mesh roller to fill the ink into the cells and then the excess ink out of the cells is removed from the mesh roller by using a doctor blade. The ink filled in the cells; constant quantity, is directly supplied to a printing roller or through some rollers to transfer the ink.

In order to excessively apply ink to the mesh roller, conventional systems as shown in FIG. 7 to FIG. 9 have been employed. In FIG. 7, a mesh roller 101 is rotated with immersing a part of the circumferential surface of the roller 101 in the ink stored in an ink fountain pan 102. The excess ink is removed from its surface by scraping function of a doctor blade 104 which contacts with the circumferential surface of the mesh roller 101. In FIG. 8, a fountain roller 103 is partially immersed in the ink in the ink fountain pan 102 and a gap l is defined between the mesh roller 101 and the fountain roller 103. The ink on the fountain roller 103 is supplied to the mesh roller 101 through the gap l. The ink is filled into the cells formed in the mesh roller 101 with the pressure caused by rotating motion. The excess ink is removed from its surface by scraping function of a doctor blade 104 which contacts with the external surface of the mesh roller 101. In FIG. 9, the mesh roller 101 is provided with an ink nozzle having a closed space 105 defined by doctor blades 104. Ink is applied from the ink nozzle to the surface of the mesh roller 101 under pressure to fill the ink into the cells. Then the excess ink is removed from the mesh roll 101 by scraping function of the doctor blade 104.

In these conventional systems, the contact angle of the doctor blade is fixed or moved within an angle of 2° to 3°. If such systems are employed in a rotary press for color printing, such fixed doctor blade may not perform its scraping function when the viscosity of the ink is relatively high or varied on its colors. This may cause fluctuation such as over-supply or under-supply of ink amount, thereby resulting in printing faults.

SUMMARY OF THE INVENTION

It is therefore an object of the present invention to provide an ink supplying apparatus which can be adapted to any type of inks.

Another object of the present invention is to provide an ink supplying apparatus wherein the contact angle and/or contact pressure of the doctor blade with respect to the mesh roller surface can be adjusted.

To accomplish these objects the ink supplying apparatus according to the present invention, comprises an ink feeding means for feeding ink onto the circumferential surface of the mesh roller, a doctor blade for contacting with the circumferential surface of the mesh roller, a pivoting means for pivotably moving the doctor blade in a sector form through a pivot parallel to the mesh roller, and a shifting means for adjusting the space between the doctor blade and the mesh roller.

Other objects and advantages of the present invention will become apparent during the following discussion of the accompanying drawings.

DETAILED DESCRIPTION OF THE PREFERRED EMBODIMENT

Figure 1:
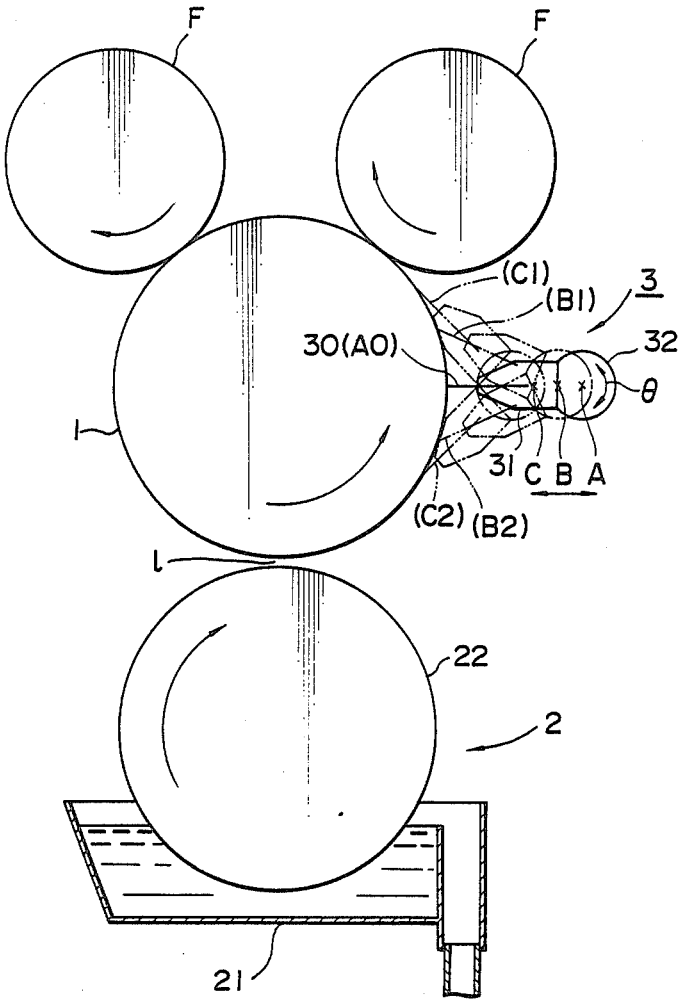
FIG. 1 is a schematic illustration showing the overall view of the ink supplying apparatus and the actuating states of the doctor blade.

One preferred embodiment of the ink supplying apparatus according to the present invention will be discussed in conjunction with the drawings. FIG. 1 schematically shows the actuating states of the apparatus. In the drawing, the reference numeral 1 denotes a mesh roller and the numeral 2 denotes an ink feeding means which comprises an ink fountain pan 21 and a fountain roller 22. The roller 22 is partially immersed in the ink stored in the fountain pan 21. As the fountain roller 22 is revolved, the ink is applied to the circumferential surface of the roller 22 and supplied to that of the mesh roller 1. A gap l is defined between the surfaces of the fountain roller 22 and the mesh roller 1. The ink layer applied to the circumferential surface of the fountain roller 22 is thicker than the gap l. This ink layer is subjected to the pressure as it passes through the gap l, so that the ink is filled into the cells formed in the mesh roller 1. The circumferential surface of the mesh roller 1 is excessively supplied with ink from the fountain roller 22. Then the ink supplied surface of the mesh roller 1 is met with a doctor blade 3 and the excess ink is scraped off by the blade 3. The removed ink is returned to the ink fountain pan 21.

Figure 2:
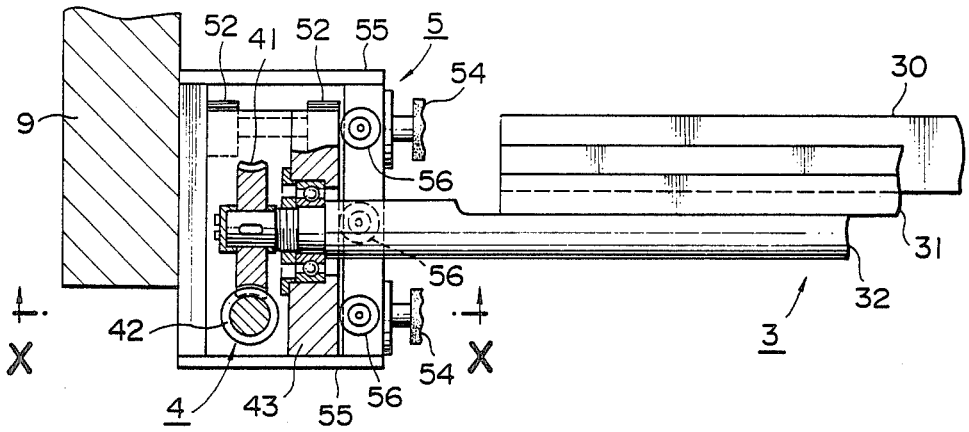
FIG. 2 is a partially sectional view taken along the line Y—Y in FIG. 3 showing the pivoting and shifting means.
Figure 3:
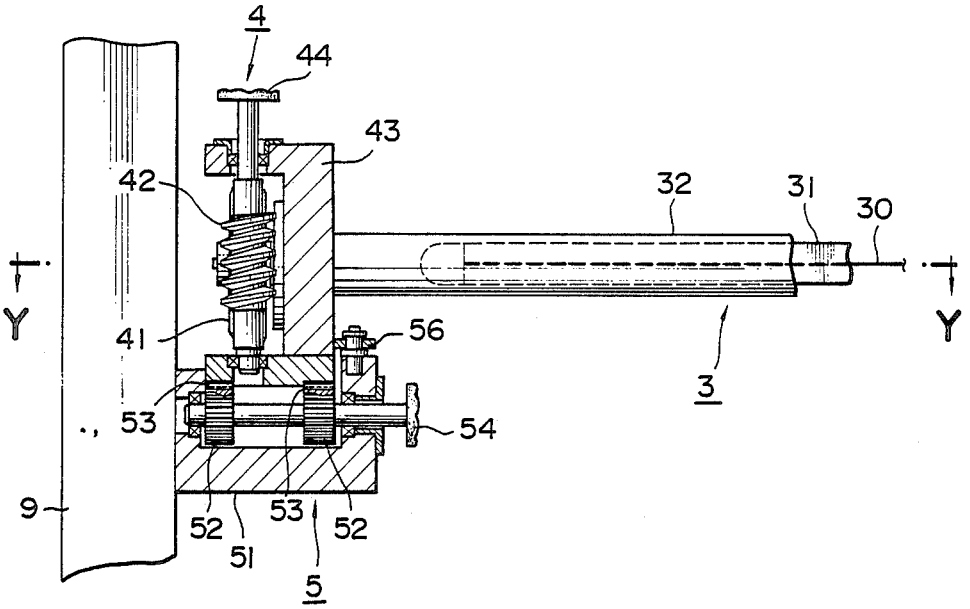
FIG. 3 is a partially sectional view taken along the line X—X in FIG. 2 showing the pivoting and shifting means.

FIG. 2 and FIG. 3 show the structure of the doctor blade 3 in detail. In these drawings, a blade 30 is held by a blade holder 31 which is fixed to a pivotable shaft 32. The shaft 32 is connected to a pivoting means 4 comprising a worm wheel 41 and a worm gear 42. As a handle 44 is revolved, the shaft 32 is pivoted in the direction represented by the allow $\theta$ in FIG. 1. According to this mechanism, the doctor blade 3 can be pivoted in a with respect to the circumferential surface of the mesh roller 1. Further, the doctor blade 3 is provided with a shifting means 5 to adjust the distance between the center of the mesh roller 1 and the doctor blade 3. This shifting means 5 comprises a bracket 43 supporting one end of the pivotable shaft 32, a pair of racks 53 fixed to the bottom of the bracket 43, a bracket base 51 for receiving the bracket 43, a pair of pinion gears 52 pivotably set on the base 51 so as to engage with the racks 53, and a pair of handles 54. As the handles 54 are revolved, the axis of the shaft 32 is freely shifted as represented by the positions A, B, and C shown in FIG. 1. This shifting operation varies the distance between the circumferential surface of the mesh roller 1 and the doctor blade 3. This shifting means 5 is fixed on a frame member 9.

According to the above mentioned structure, the contact angle of the doctor blade 3 to the mesh roller 1 can be freely controlled in the range of C1, B1, A0, B2, and C1 as shown in FIG. 1 by adjusting the pivoting means 4 and the shifting means 5. In other words the contact angle can be varied from the tangent line C1 following to the revolving direction to the tangential line C2 in the counter direction of the revolving. Also the contact pressure can be freely controlled by these means.

After controlling the doctor blade 3 the pivoting means 4 and the shifting means 5 are fixed by any well known lock means, not shown in the drawings. The stroke end of the shifting means 5 depends on the position of a stopper 55 which is arranged so as to contact the end of the bracket 43 with te base 51. The bracket 43 is guided by rollers 56.

After the excess ink on the mesh roller 1 is scraped off by the doctor blade 3 to adjust the ink quantity, the ink on the mesh roller 1 is transferred to a form roller F by revolving the mesh roller 1. Finally the ink is supplied to a printing plate of a plate cylinder.

Figure 4:
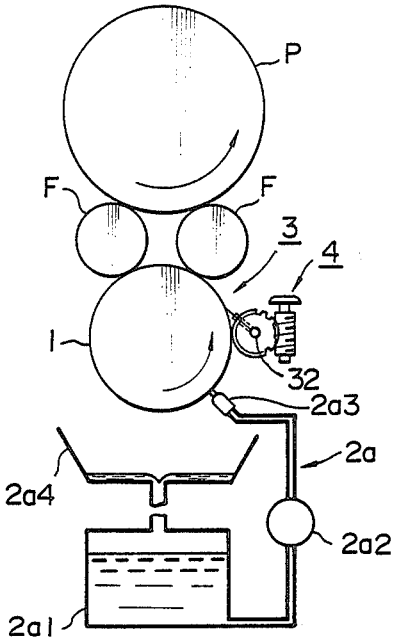
FIG. 4, FIG. 5 and FIG. 6 are schematic illustrations showing various ink feeding means to which the ink supplying apparatus of the present invention is applied.
Figure 5:
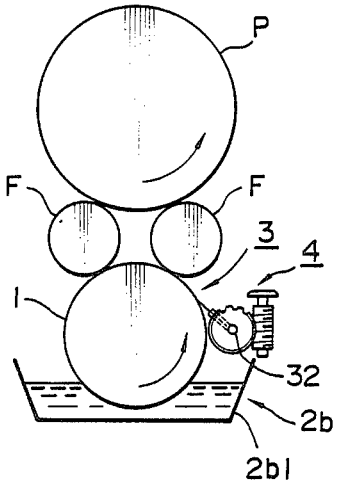
Figure 6:
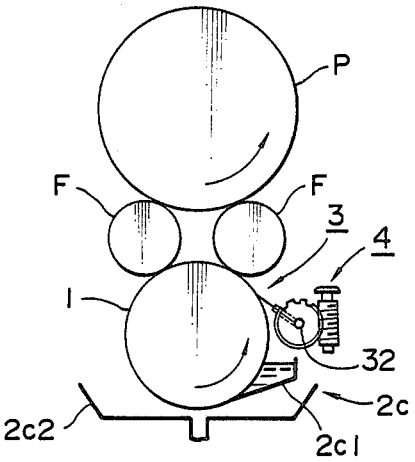
Figure 7:
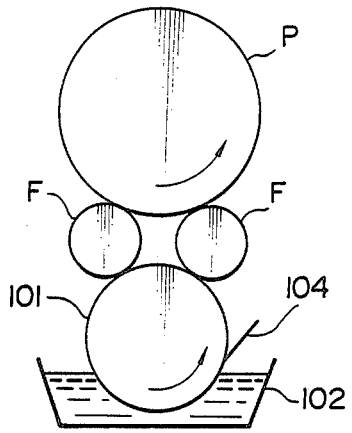
FIG. 7 PRIOR ART
FIG. 7, FIG. 8 and FIG. 9 are schematic illustrations showing the conventional systems.
Figure 8:
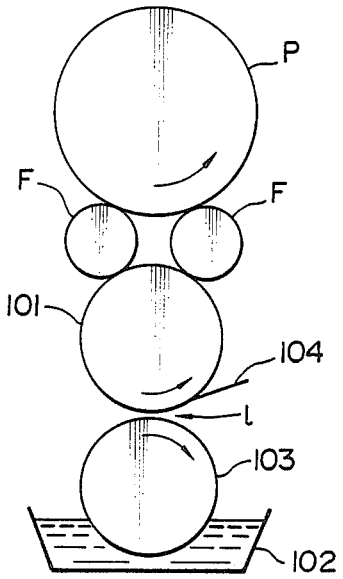
FIG. 8 PRIOR ART
Figure 9:
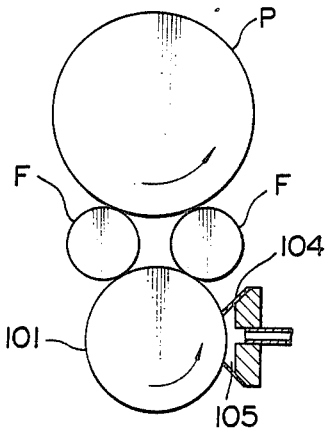
FIG. 9 PRIOR ART

The ink feeding means 2 comprising the ink fountain pan 21 and the ink fountain roller 22, shown in FIG. 1, may be replaced by other constitutions as shown in FIG. 4, FIG. 5 and FIG. 6. In these drawings, the ink feeding means are respectively represented by the numerals *2a*, *2b*, and *2c*.

In FIG. 4, the ink feeding means comprises an ink fountain pan 2a1, a pump 2a2, a nozzle 2a3 and an ink receiver 2a4 for recovering the ink. The ink stored in the ink fountain pan 2a1 is fed to the nozzle 2a3 through the pump 2a2 to inject it onto the mesh roller 1. The excess ink is off by the doctor blade 3 and the scraped ink is received by the ink receiver 2a4.

FIG. 5 shows other ink feeding means comprising an ink fountain pan 2b1 in which the mesh roller 1 is directly immersed.

FIG. 6 shows also ink feeding means comprising an ink reservoir 2c1 and an ink receiver 2c2 for recovering the excess ink. The mesh roller 1 is immersed into the ink reservoir 2c1 and the excess ink is scraped off by the doctor blade 3.

In these drawings, the doctor blade 3 is actuated in the same manner as FIG. 1.

Although the invention has been described in its preferred form with a certain degree of particularity, it is understood that the present disclosure of the preferred form has been changed in the details of construction and the combination and arrangement of parts may be resorted to without from the spirit and the scope of the invention as hereinafter claimed.

What is claimed is:

1. An ink supplying apparatus for use with inks having various viscosities, comprising:

a rotating printing cylinder;

a rotating cylindrical feeding roller having a mesh circumferential surface;

means for feeding ink onto said circumferential surface of said feeding roller;

means for feeding ink from said feeding roller to said printing cylinder;

a blade shaft mounted in a parallel relation to the longitudinal axis of said feeding roller, having a doctor blade pivotably disposed on said blade has, such that said doctor blade contacts said circumferential surface at a predetermined contact angle and with a predetermined pressure;

means for pivotably moving said doctor blade about said blade shaft;

shifting means for varying the distance between said blade shaft and said feeding roller axis in a common plane;

wherein said means for pivotably moving said doctor blade varies said contact angle from a tangential line following the rotation of said feeding roller to a tangential line in the counter direction of rotation of said feeding roller;

said means for pivotably varying said doctor blade and said means for varying the distance between said blade shaft and said feeding roller axis vary the pressure between said doctor blade and said circumferential surface of said roller;

said pivotably moving means comprising a worm wheel mounted on said blade shaft, a worm gear operatively engaging said worm wheel, and a first handle; and said shifting means comprising a bracket for supporting said blade shaft, a rack fixed to said bracket, a bracket base for receiving said bracket, at least one pinion gear pivotably mounted on said base, and a second handle in operative association with said pinion gear, whereby said contact angle is controlled by operating said first handle, and the space between said doctor blade and said circumferential surface is controlled by operating said second handle.

* * * * *